US007267131B2

(12) United States Patent
Woo

(10) Patent No.: US 7,267,131 B2
(45) Date of Patent: Sep. 11, 2007

(54) RACK ASSEMBLY IN DISHWASHER

(75) Inventor: Woo Sang Woo, Gumi-si (KR)

(73) Assignee: LG Electronics Inc., Seoul (KR)

( * ) Notice: Subject to any disclaimer, the term of this patent is extended or adjusted under 35 U.S.C. 154(b) by 435 days.

(21) Appl. No.: 10/935,124

(22) Filed: Sep. 8, 2004

(65) Prior Publication Data

US 2005/0241686 A1 Nov. 3, 2005

(30) Foreign Application Priority Data

May 3, 2004 (KR) ..... 10-2004-0030947

(51) Int. Cl.
*B08B 3/02* (2006.01)

(52) U.S. Cl. ..... 134/135; 211/41.3

(58) Field of Classification Search ..... 134/135; 211/41.3

See application file for complete search history.

(56) References Cited

U.S. PATENT DOCUMENTS 2,552,852 A * 5/1951 Idle ..... 134/93
3,025,864 A * 3/1962 Ensign ..... 134/115 G
3,050,073 A * 8/1962 McMillan ..... 134/137
3,934,728 A * 1/1976 Guth ..... 211/41.9

FOREIGN PATENT DOCUMENTS

JP 2000-217770 * 8/2000

OTHER PUBLICATIONS

European Patent Office 0 143 754 Jun. 1985.*
European Patent Office 1 128 347 Aug. 2001.*

* cited by examiner

*Primary Examiner*—Frankie L. Stinson
(74) *Attorney, Agent, or Firm*—McKenna, Long & Aldridge LLP

(57) ABSTRACT

Rack assembly in a dishwasher including a hollow main rack drawable from a washing chamber for placing tableware thereon, and a supplementary rack detachably, and shiftably mounted on an inside of the main rack, for placing the tableware therein, thereby permitting efficient use of the tableware receiving space because the supplementary rack is detachable from the main rack and a position of the supplementary rack can be shiftable within the main rack.

19 Claims, 7 Drawing Sheets

RACK ASSEMBLY IN DISHWASHER

This application claims the benefit of the Korean Application No. P2004-0030947 filed on May 3, 2004, which is hereby incorporated by reference.

BACKGROUND OF THE INVENTION

1. Field of the Invention

The present invention relates to dishwashers, and more particularly, to a rack assembly in a washing chamber for placing tableware thereon.

2. Description of the Related Art

The dishwasher washes and dries tableware automatically, by spraying washing solution and washing water to the tableware. FIG. 1 illustrates a typical dishwasher, referring to which the dishwasher will be described in more detail.

Referring to FIG. 1, the typical dishwasher 10 is provided with a case 30 forming an exterior, a washing chamber 1 in the case 30, and a door 11 mounted on a front of the case 30, for opening/closing the washing chamber 1, and the rack 20 in the washing chamber 1 for placing various tableware thereon.

In more detail, the rack 20 has a horizontal bottom frame 22 having ends extended upward for a predetermined length, a side frame 21 around the sides of the bottom frame 22, and at least one rollers 26 on opposite edges of the bottom of the rack 20 for front/rear movement of the rack 20.

Moreover, the rack 20 is provided with receptacle holders 23 for holding bowls or cups, dish holders 24 for holding flat dishes, and spoon holders for holding various spoons and forks.

However, since the receptacle holders 23, the dish holders 24, and the like are rigidly fixed to the bottom frame 22 and/or the side frame 21 in the related art rack 20, spaces for holding bulky receptacles or large dishes are limited due to various holders fixed to the rack 20, leading to fail effective use of a rack space, to fail placing many receptacle and dishes on the rack at a time, to require many times of tableware washing by small amount, to waste power and washing water.

SUMMARY OF THE INVENTION

Accordingly, the present invention is directed to a rack assembly in a dishwasher that substantially obviates one or more of the problems due to limitations and disadvantages of the related art.

An object of the present invention is to provide a rack assembly in a dishwasher, which enables effective use of a rack space according to a volume and size of tableware.

Additional features and advantages of the invention will be set forth in the description which follows, and in part will be apparent to those having ordinary skill in the art upon examination of the following or may be learned from practice of the invention. The objectives and other advantages of the invention will be realized and attained by the structure particularly pointed out in the written description and claims hereof as well as the appended drawings.

To achieve these objects and other advantages and in accordance with the purpose of the present invention, as embodied and broadly described herein, the rack assembly in a dishwasher includes a hollow main rack drawable from a washing chamber for placing tableware thereon, and a supplementary rack detachably, and shiftably mounted on an inside of the main rack, for placing the tableware therein.

At least any one of the main rack or the supplementary rack is framed of a plurality of strips in a form of a lattice.

The main rack includes a bottom for placing tableware thereon, and sidewalls formed around the bottom. The main rack includes a plurality of rollers in a lower part of the main rack. The main rack includes holders projected from the bottom for holding the tableware.

The supplementary rack includes a long bottom insertable in an inside of the main rack, and sidewalls extended upward from opposite edges of the bottom respectively, for being brought into contact with, and held by the main rack. The sidewalls are elastically moved away or closer to each other in a length direction of the bottom.

The supplementary rack includes a plurality of holders projected from a bottom for holding the tableware. The holders are slanted. The holder is bent such that a part is projected upward, and has both ends fixed to the bottom. The supplementary rack includes at least one slot for inserting, and holding a dish.

The sidewall of the supplementary rack includes a step on an outside surface for engagement with, and held by a part of the main rack. The sidewall of the supplementary rack includes a supporter projected outward from the sidewall for being brought into contact with, and held by the main rack. The supporter includes at least one vertical slot on an outside surface. The supporter includes an outside surface rugged in a horizontal direction.

There is a handle at a top of the sidewall of the handle for the user to hold. The handle may be formed as one unit with the supporter, or detachable from the handle or the supplementary rack.

It is to be understood that both the foregoing description and the following detailed description of the present invention are exemplary and explanatory and are intended to provide further explanation of the invention claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention.

In the drawings.

DETAILED DESCRIPTION OF THE PREFERRED EMBODIMENT

Reference will now be made in detail to the preferred embodiments of the present invention, examples of which are illustrated in the accompanying drawings. In describing the embodiments, identical parts will be given the same names and reference symbols and repetitive description of which will be omitted.

Figure 1:
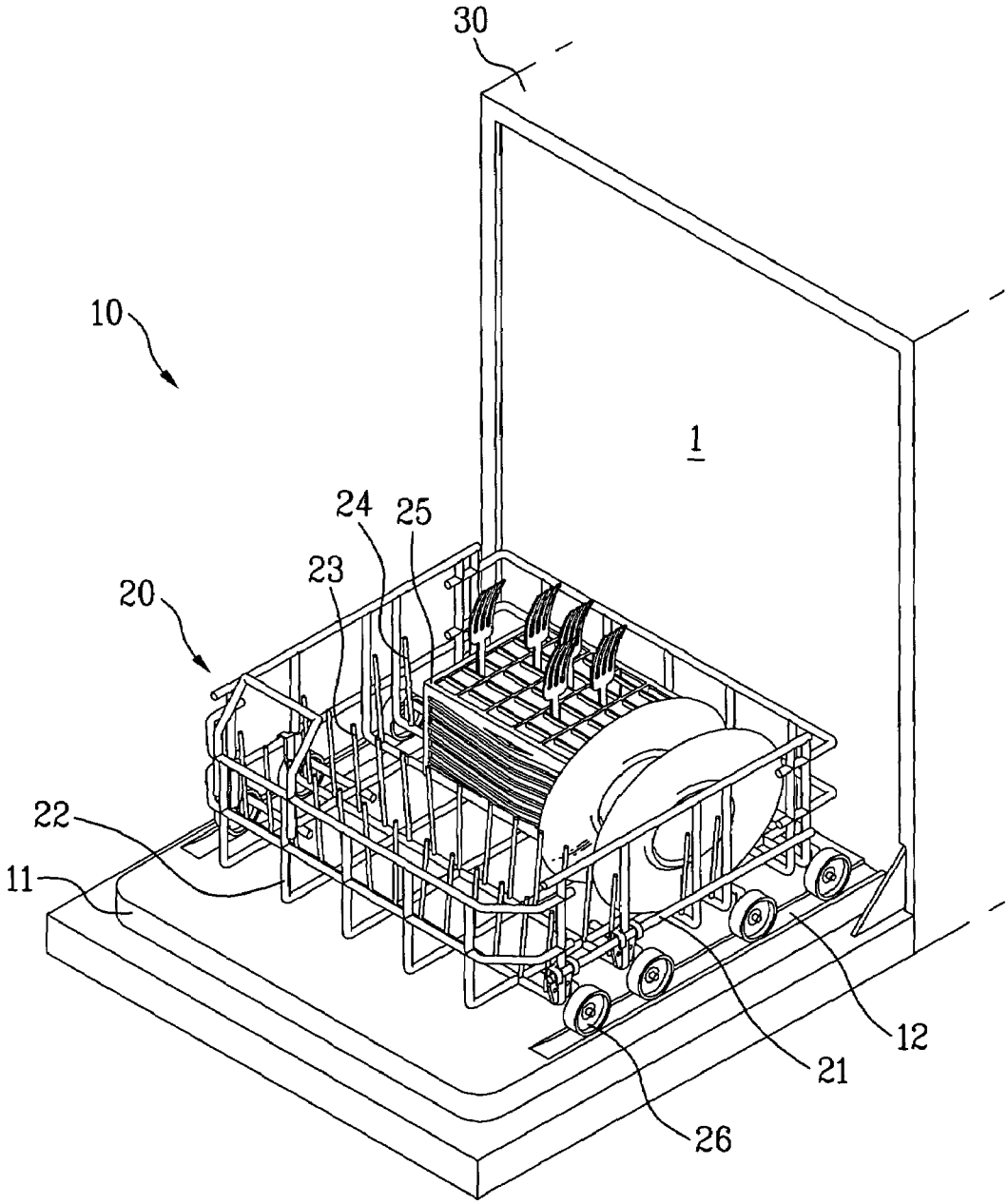
FIG. 1 Related Art
FIG. 1 illustrates a perspective view of a typical rack in a dishwasher.
Figure 2:
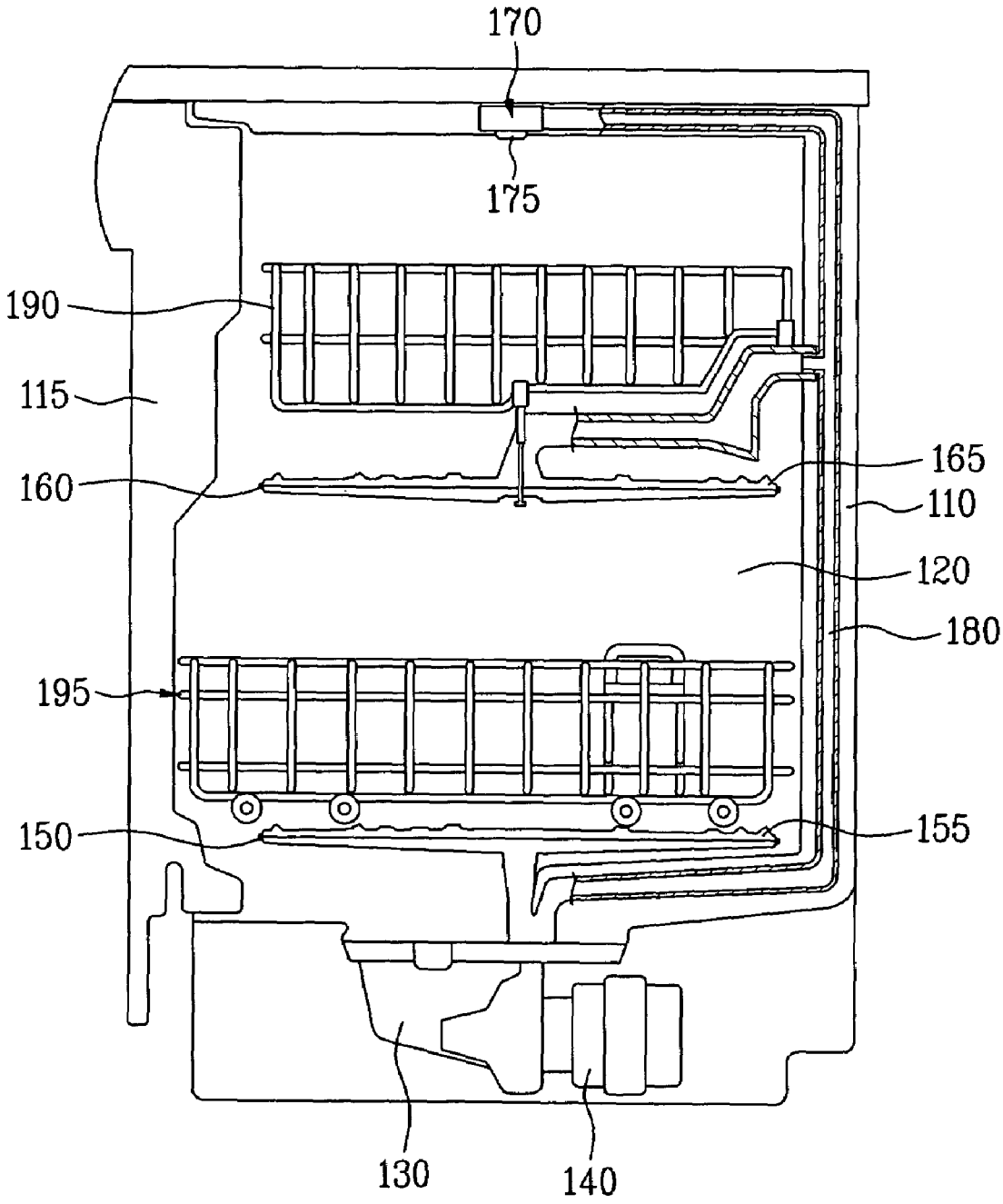
FIG. 2 illustrates a diagram showing a dishwasher having a rack assembly in accordance with a preferred embodiment of the present invention, schematically.

FIG. 2 illustrates a diagram showing a dishwasher having a rack assembly in accordance with a preferred embodiment of the present invention, schematically.

Referring to FIG. 2, there is a washing chamber 120 in a case 110 opened/closed with a door 115 in a front of the case 110.

There is a sump 130 under the washing chamber 120, for holding washing water. The sump 130 holds clean water supplied at the time of water supply. For this, the sump 130 has a water supply pipe (not shown) and a water supply valve (not shown) connected thereto. Moreover, the sump 130 also receives, and holds contaminated washing water having washed the tableware in the washing chamber 120 and dropped down therefrom in the washing. There is a filtering device (not shown) connected to the sump 130 for filtering the contaminated washing water in the washing.

Referring to FIG. 2, the sump 130 has a pump 140 connected thereto for pumping the washing water from the sump 130. The pump 140 has a motor connected to one side of the sump 130, and an impeller in the sump 130 coupled to the motor with a shaft. Therefore, upon putting the motor into operation, the impeller rotates to pump the washing water from the sump 130 as the impeller rotates.

In the meantime, in the washing chamber 120, there is at least one sprayer, for an example, an upper arm 160, a lower arm 150, and a top arm 170. Each of the upper arm 160, the lower arm 150, and the top arm 170 is provided with a nozzle 165, 155, or 175. There is a tube connecting the pump 140 to the upper arm 160, the lower arm 150, and the top arm 170.

Therefore, when the pump 140 is put into operation, the washing water is pumped, and supplied from the sump 130 to the upper arm 160, the lower arm 150, and the top arm 170, through the tube 180, and sprayed to an inside of the washing chamber 120 through the nozzles 165, 155, and 175. In this instance, the upper arm 160, and the lower arm 150 spray the washing water upward, and the top arm 170 sprays the washing water downward.

In the meantime, the upper arm 160, the lower arm 150, and the top arm 170 are rotatably mounted, and the nozzles 165, 155, and 175 spray the washing water, slantingly. According to this, the upper arm 160, the lower arm 150, and the top arm 170 rotate by reaction forces generated when the nozzles 165, 155, and 175 spray the washing water, slantingly. Therefore, the washing water sprayed from the nozzles 165, 155, and 175 is sprayed to an inside of the washing chamber 120, uniformly.

In the meantime, for stable holding of the tableware washed by the washing water sprayed from the upper arm 160, the lower arm 150, and the top arm 170, there is at least one rack in the washing chamber 120, for an example, the upper rack 190, and the lower rack 195. The upper rack 190 is arranged over the upper arm 160, and the lower rack 195 is arranged over the lower arm 150.

For reference, though FIG. 2 illustrates an example in which a rack assembly of the present invention is applied to the lower rack 195, the present invention is not limited to this. That is, the rack assembly of the present invention can be applied to any one of the upper rack 190 or the lower rack 195. A rack assembly of the present invention provided in the washing chamber 120 for holding tableware will be described with reference to FIGS. 3 to 7, in more detail.

Figure 3:
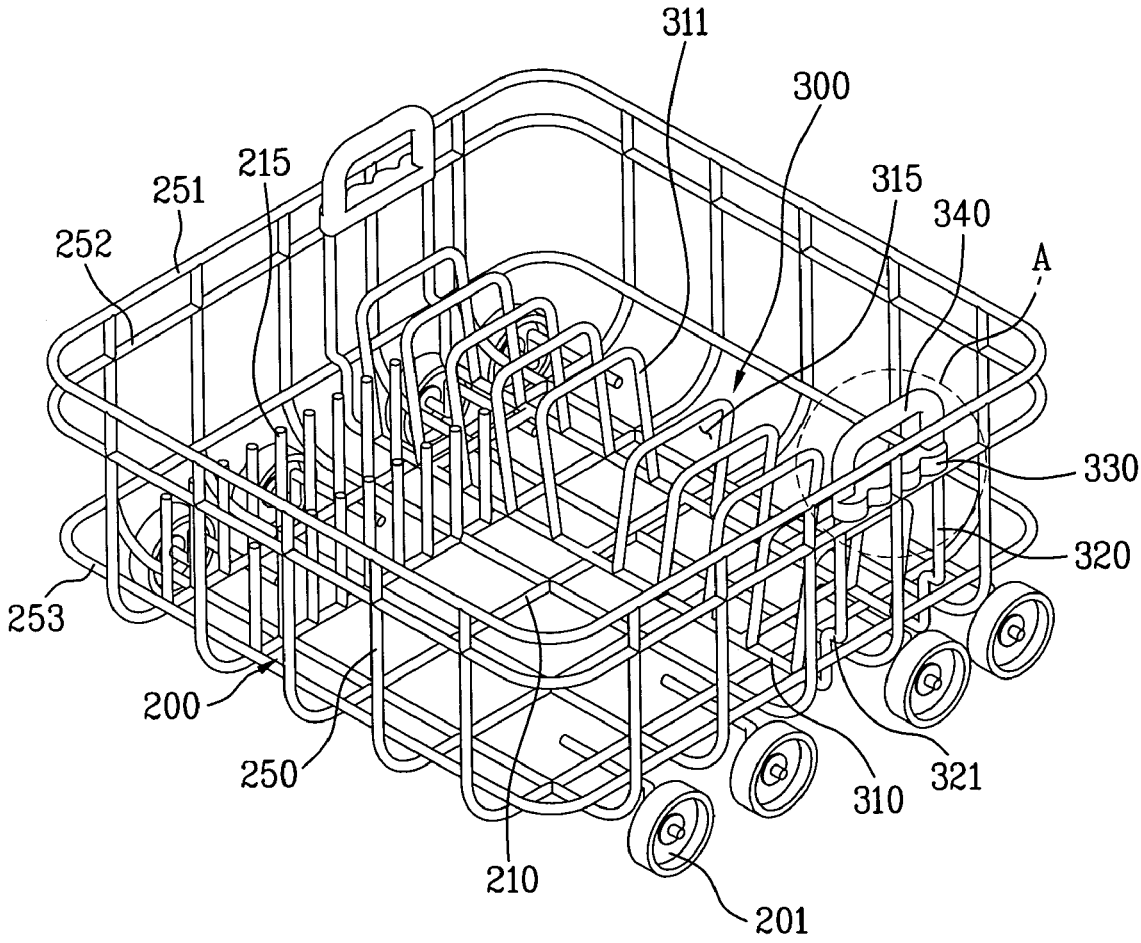
FIG. 3 illustrates a perspective view of a rack assembly in accordance with a preferred embodiment of the present invention.

Referring to FIG. 3, the rack assembly includes a main rack 200, and a supplementary rack 300 in the main rack 200 detachable from, and shiftable within the main rack 200.

The main rack 200 is provided, for an example, in the washing chamber 120 drawable therefrom. For easy pushing in, or drawing out of the main rack 200 to/from the washing chamber 120, the main rack 200 is provided with a plurality of rollers 210 at, for an example, opposite sides of a bottom of the main rack 200, and rails (not shown) are provided on opposite sides of the bottom or sidewalls of the washing chamber 120.

The main rack 200 is hollow for receiving tableware therein, and, for this, as shown in FIG. 3, has a bottom 210 (hereafter called as a first bottom) and sidewalls 250 (hereafter called as a first sidewall). The first bottom 210 has a size enough to place tableware thereon, and the first sidewalls 250 are formed vertical to, and around the first bottom 210.

The foregoing main rack 200 may be framed of, for an example, a plurality of metal or plastic strips to form a lattice, which will be described with reference to FIG. 3.

Referring to FIG. 3, a plurality of strips are arranged to cross perpendicular to each other, to form the first bottom 210, and ends of the strips of the first bottom 210 are bent upward, vertically. Then, as shown in FIG. 3, a plurality of horizontal strips are crossed perpendicular to the strips bent vertically, to form the first sidewalls 250. For reference, FIG. 3 illustrates an example in which a first strip 251 is on a top of the first sidewall 250, and a third strip 253 is in a lower part of the first sidewall 250, and a second strip 252 between the first strip 251 and the third strip 253.

In the meantime, tableware is placed on the first bottom 210 of the main rack 200. Therefore, a plurality of holders 215 (hereafter called as first holders) are provided to the first bottom 210. As shown in FIG. 3, the first holders 215 are projected from the first bottom 210 in forms of bars, spaced at regular intervals from each other.

The first holders 215 on the first bottom 210 enables to insert flat tableware, such as small dishes, inserted between the first holders 215. Hollow tableware, like cups, may be placed on the first bottom 210 upside down to face an opened part thereof down and the first holder 215 positioned within the tableware.

Positions and heights of the first holders 215 are determined appropriately within a range in which the space of the main rack 200 can be utilized to the maximum. For reference, FIG. 3 illustrates an example in which the first holders 215 are provided only to one corner of the first bottom 210. In this case, rest of the space of the first bottom where no first holders 215 are provided is used as a reserved space for mounting the supplementary rack 300 or placing large tableware.

Figure 4:
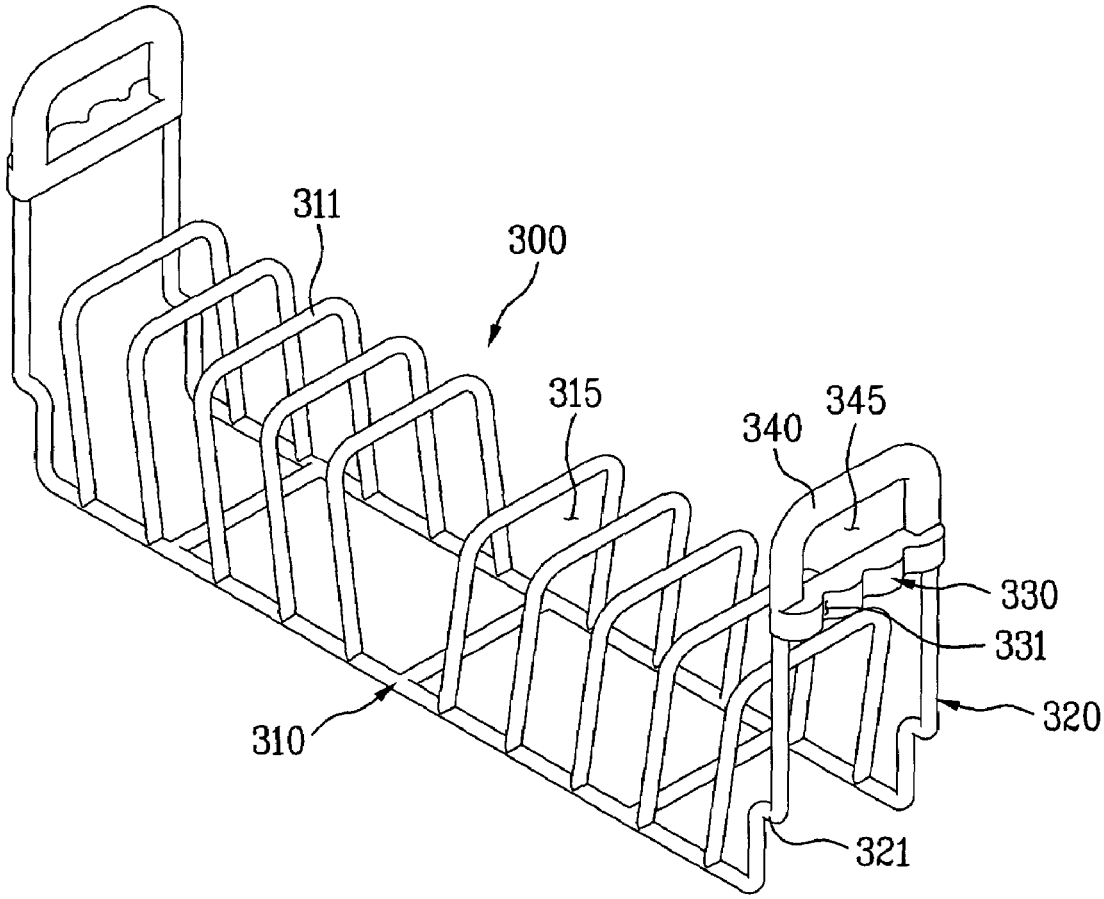
FIG. 4 illustrates a perspective view of a supplementary rack of the rack assembly in FIG. 3 in accordance with a preferred embodiment of the present invention.

Referring to FIG. 3, the supplementary rack 300 may be attached or detached to/from an inside of the main rack 200, and shiftable within the main rack 200. As shown in FIGS. 3 and 4, the supplementary rack 300 includes a bottom 310 (hereafter called as a second bottom) and sidewalls 320 (hereafter called as second sidewalls), which will be described in more detail.

Referring to FIG. 4, the second bottom 310 is long, and, as shown in FIG. 3, can be inserted in the main rack 200. Tableware like large dishes can be placed on the second bottom 310, and for stable holding of the tableware, the second bottom 310 has a plurality of holders 311 (hereafter called as second holder) provided thereon.

The second holders 311 are projected upward from the second bottom 310 at regular intervals. For an example, as shown in FIG. 3, the second holder 311 has a form in which the second holder 311 is bent such that a part thereof is projected upward, and has both ends fixed to the bottom.

Above structures of the second holders 311 form a kind of slot 315 between two adjacent second holders 311. Accordingly, as shown in FIG. 4, tableware, such as large dishes, can be inserted between, and held stably with, a plurality of slots 315 formed of the second holders 311 between the second sidewalls 320.

As shown in FIG. 4, though the second holders 311 may be vertical to the second bottom 310, the second holders 311 may be slanted. Then, as the tableware inserted in the slots 315 between the second holders 311 are also slantingly held, areas of contact between the tableware and the washing water sprayed upward or downward become larger. For reference, FIG. 4 illustrates an example in which the second holders 311 are slanted in opposite directions with reference to middle of the second bottom 310.

In the meantime, the second sidewalls 320 extend upward from opposite edges of the second bottom 310, respectively. As shown in FIG. 3, the second sidewalls 320 are brought into contact with, and held by the first sidewalls 250 when the supplementary rack 300 is mounted on an inside of the main rack 200.

The supplementary rack 300 may be framed of metal or plastic strips. For an example, as shown in FIG. 3, by arranging at least two long strips parallel to each other, and making a short strip to cross middle of the long strips, the second bottom 310 can be formed. Then, by bending opposite ends of the long strips upward vertically, the second sidewalls 320 are formed. In this instance, horizontal short strips may be provided to the second sidewalls 320.

Referring to FIG. 4, there may be steps 321 at outer sides of the second sidewalls 320, respectively. As shown in FIG. 3, the steps 321 are engaged with, and held by parts of the main rack 200, for an example, the third strips 253 provided horizontal to the first sidewalls 250 when the supplementary rack 300 is mounted on the main rack 200. In this instance, as shown in FIG. 3, for easy engagement of the steps 321, the third strip 253 may be projected to an inside of the main rack 200.

Figure 5:
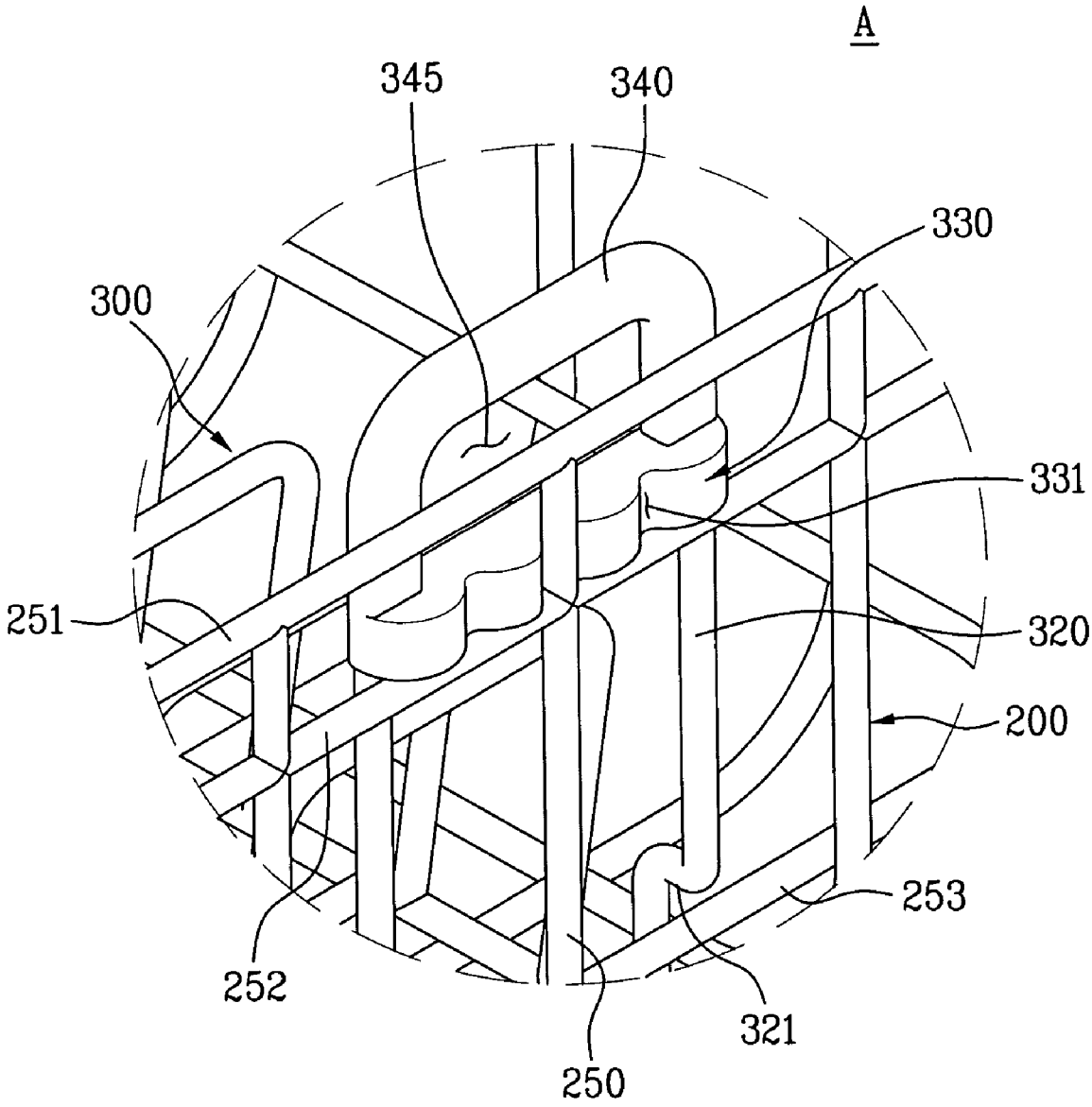
FIG. 5 illustrates an enlarged view of 'A' part in FIG. 3.

In the meantime, it is preferable that the supplementary rack 300 mounted on an inside of the main rack 200 remains still within the main rack 200 during washing. Therefore, as shown in FIGS. 4 and 5, for securer holding of the supplementary rack 300 by the main rack 200, the second sidewalls 320 are provided with supporters 330, respectively. The supporter 330 extends in a horizontal direction of the second sidewall 320, and is projected to an outside of the supplementary rack 300 from an outside surface of the second sidewall 320 for being brought into contact with, and held by the first sidewall 250 of the main rack 200.

Referring to FIG. 3, when the supplementary rack 300 is mounted on the main rack 200, the supporter 330 is inserted between two horizontal strips of the first sidewall 250, in more detail, the first strip 251 and the second strip 252 parallel to, and under the first strip 251, and are brought into contact with vertical strips of the first sidewall 250.

In this instance, it is preferable that a space between the first strip 251 and the second strip 252 is equal to, of slightly greater than thickness of the supporter 330. Then, the supplementary rack 300 on the main rack 200 is held by the first strip 251, the second strip 252, and the supporter 330, without moving in up/down directions.

The supporter 330 has at least one up/down direction slot in an outside surface, or a rugged outside surface in a horizontal direction. As shown in FIGS. 3 and 5, if the supporter 330 has such a slot 331, or the rugged outside surface, the vertical strip of the first sidewall 250 can be inserted in the slot 331, or a recessed part of the rugged surface. According to this, when the supplementary rack 300 is mounted on an inside of the main rack 200, horizontal movement of the supplementary rack 300 can be prevented. For reference, it is preferable that a width of the slot 331 is the same with a diameter of the vertical strip of the first sidewall 250, substantially.

In the meantime, the supplementary rack 300 may be provided with a handle 340 for easy mounting of the supplementary rack 300 on the main rack 200, and easy shifting of a position of the supplementary rack 300 within the main rack 200. As shown in FIG. 4, the handle 340 is provided to an upper part of the second sidewall 320 for user's easy holding of the handle 340, and there is an opening 345 between the handle 340 and the supporter 330, of a size a user fingers can be inserted therein. Such as handle 340 is formed of a plastic, and inserted on, and fixed at a top of the second sidewall 320.

Figure 6:
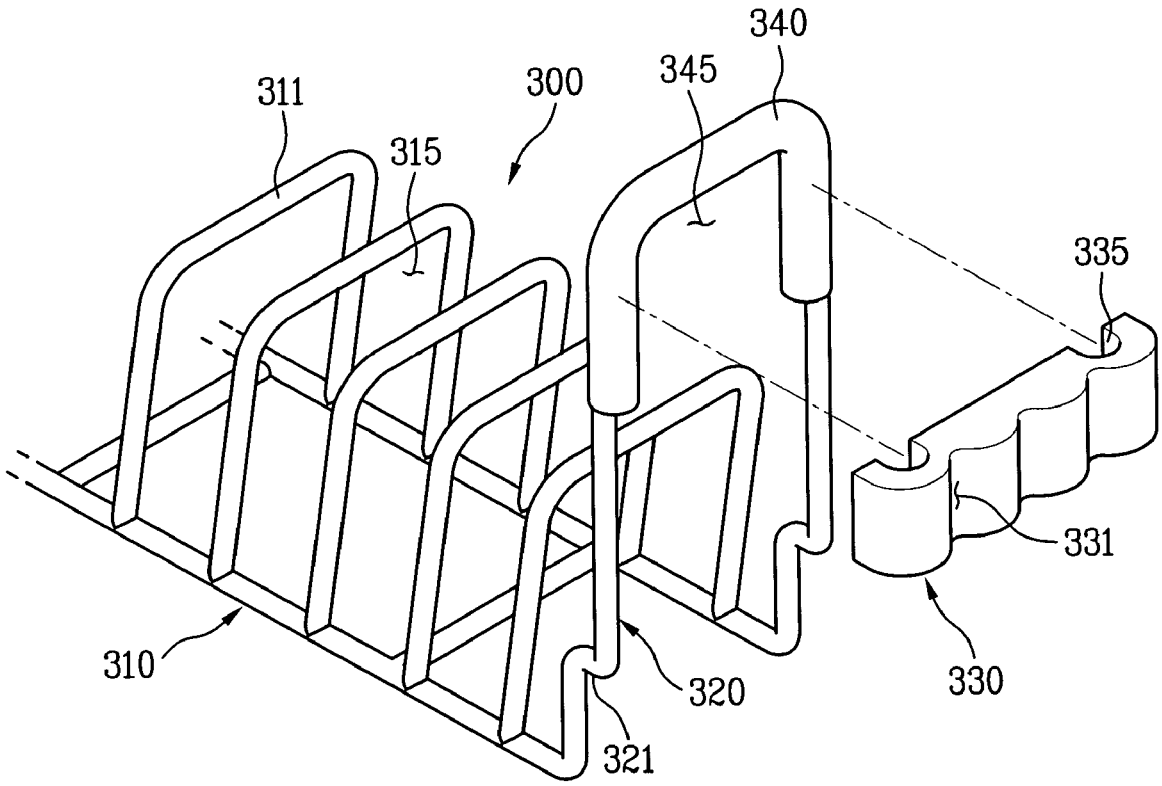
FIG. 6 illustrates a disassembled perspective view of a supplementary rack of the rack assembly in FIG. 3 in accordance with other preferred embodiment of the present invention.

Referring to FIGS. 3 to 5, in a case the handle 340 and the supporter 330 are provided together, the handle 340 and the supporter 330 can be formed as one unit. However, the structures of the handle 340 and the supporter 330 are not limited to this, but, as shown in FIG. 6, the supporter 330 may be formed to be attached/detached to/from the second sidewall 320 or the handle 340. In this case, the supporter 330 has slots in both sides for inserting and holding parts of vertical strips of the second sidewall 320 or the handle 340.

In the supplementary rack 300, the second sidewalls 320 can move away from or close to each other elastically in a length direction of the second bottom 310. Therefore, after inserting the supplementary rack 300 in the main rack 200 in a state the second sidewalls 320 are moved toward an inside of the supplementary rack 300 with the handles 340 held by hands, a force having moved the second sidewalls 320 toward an inside of the supplementary rack 300 is removed, the supplementary rack 300 is mounted. In this instance, as shown in FIG. 5, since the supporter 330 is inserted between the first strip 251 and the second strip 252, and the vertical strip of the second sidewall 320 is inserted in the slot 331 or recess part of the supporter 330, the supplementary rack 300 can be held by the main rack 200, securely.

In a state the supplementary rack 300 is mounted on the main rack 200, the user can place various kinds, and sizes of tableware on the main rack 200, and the supplementary rack 300 by using the first holders 215 and the second holder 311. In this instance, as shown in FIG. 3, tableware that are difficult to put by using the first holders 215 and the second holders 311 can be placed on the reserved space of the first bottom 210 of the main rack 200 where no first holders 215 or the supplementary rack 300 are provided thereto.

If it is intended to wash much tableware that is difficult to place by using the second holders 311, the supplementary rack 300 is dismounted from the main rack 200. In this instance, the handles 340 are held with two hands, the second sidewalls 320 are pushed inward until the supporters 330 are moved out of the space between the first strip 251 and the second strip 252, and the supplementary rack 300 is taken out of the main rack 200. Once the supplementary rack 300 is removed from the main rack 200, there is much empty space inside of the main rack 200. According to this, the user can place various kinds and sizes of tableware on an inside of the main rack 200.

Figure 7:
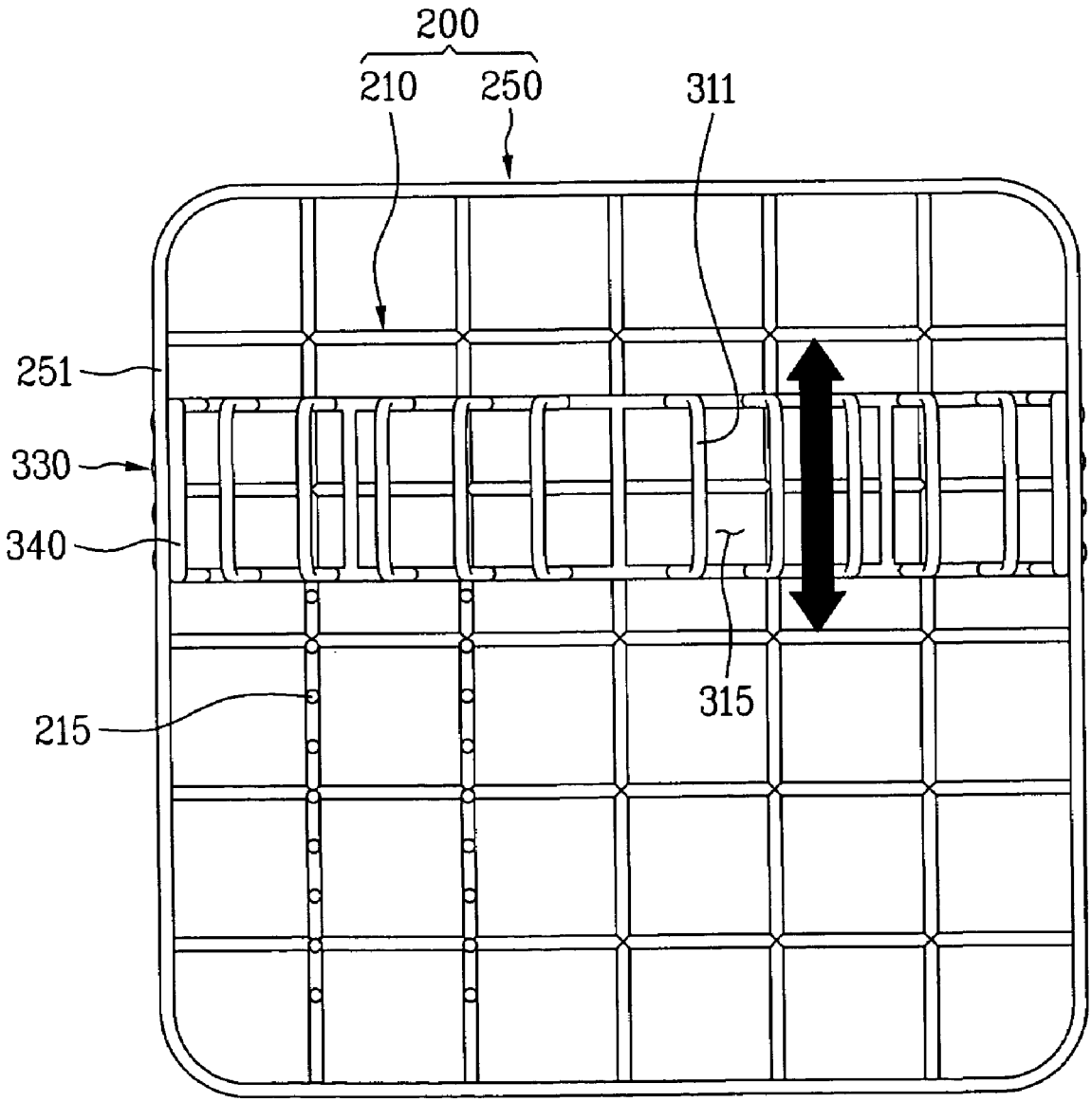
FIG. 7 illustrates a plan view showing a supplementary rack moving in a main rack in the rack assembly in FIG. 3.

Moreover, as shown in FIG. 7, a position of the supplementary rack 300 may be changed within the main rack 200 as necessary. Furthermore, the supplementary rack 300 can be mounted, not only in a width direction, but also in a length direction. The supplementary rack 300 can also be mounted on the main rack 200 to cover a part or entire part of the first holders 215. Thus, the supplementary rack 300 can be mounted anywhere in the main rack 200 without limitation of a mounting position. Accordingly, the space of the main rack 200 can be used effectively as necessary.

As has been described, the rack assembly of the present invention has the following advantages.

First, since the supplementary rack is detachable from the main rack, and shiftable within the main rack, various kinds and sizes of tableware can be placed in the dishwasher, conveniently and effectively.

Second, since the space of the receiving space of the rack assembly can be used effectively, much tableware can be washed at a time, thereby permitting to reduce washing water and power consumption.

Third, the supplementary rack can be held at the main rack by using the supporters.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A rack assembly in a dishwasher comprising:

a main rack drawable from a washing chamber for placing tableware thereon; and a supplementary rack attachably/detachably mounted on an inside of the main rack, for placing the tableware therein, wherein the supplementary rack includes:

a bottom insertable in an inside of the main rack;

sidewalls extended upward from opposite edges of the bottom respectively, and wherein the sidewalls are elastically moved away or closer to each other in a length direction of the bottom; and a supporter fastening the sidewall with the main rack when the bottom is inserted in an inside of the main rack.

2. The rack assembly as claimed in claim 1, wherein at least any one of the main rack or the supplementary rack is framed of a plurality of strips in a form of a lattice.

3. The rack assembly as claimed in claim 1, wherein the main rack includes;

a bottom for placing tableware thereon, and sidewalls formed around the bottom.

4. The rack assembly as claimed in claim 1, wherein the main rack includes a plurality of rollers in a lower part of the main rack.

5. The rack assembly as claimed in claim 1, wherein the main rack includes holders projected from the bottom for holding the tableware.

6. The rack assembly as claimed in claim 1, wherein the supplementary rack includes a plurality of holders projected from a bottom for holding the tableware.

7. The rack assembly as claimed in claim 6, wherein the holders are slanted.

8. The rack assembly as claimed in claim 6, wherein the holder is bent such that a part is projected upward, and has both ends fixed to the bottom.

9. The rack assembly as claimed in claim 1, wherein the supplementary rack includes at least one slot for inserting, and holding a dish.

10. The rack assembly as claimed in claim 1, wherein the sidewall includes a step on an outside surface for engagement with, and held by a part of the main rack.

11. The rack assembly as claimed in claim 1, wherein the supporter is projected outward from the sidewall for fastening the sidewall with a sidewall of the main rack.

12. A rack assembly in a dishwasher comprising:

a main rack framed of a plurality of strips in a form of a lattice to be drawable from a washing chamber, including;

a first bottom for placing tableware thereon, and first sidewalls extended upward from edges of the first bottom, and a supplementary rack detachably, and shiftably mounted on an inside of the main rack, including;

a long second bottom for placing the tableware thereon, second sidewalls extended upward from opposite edges of the second bottom, supporters each projected outward from the second sidewall for being brought into contact with, and held by the first sidewall, and handles each joined with the second sidewall, wherein the supporter has a horizontal rugged part for inserting the vertical strip in a recess thereof.

13. The rack assembly as claimed in claim 12, wherein the second bottom includes a plurality of holders each bent such that a part is projected upward, and has both ends fixed to the bottom, for holding the tableware.

14. The rack assembly as claimed in claim 12, wherein the supplementary rack further includes at least one slot between the sidewalls for inserting, and holding a dish.

15. The rack assembly as claimed in claim 12, wherein the second sidewall includes a step on an outside surface for engagement with, and held by a horizontal strip of the first sidewall.

16. The rack assembly as claimed in claim 12, wherein the supporter is inserted between, and held by horizontal two strips of the first sidewall when the supplementary rack is mounted on the main rack.

17. The rack assembly as claimed in claim 12, wherein the first sidewall includes;

a first strip arranged in a horizontal direction to form a top of the first sidewall, and a second strip under the first strip arranged in the horizontal direction for inserting, and holding the supporter in a space to the first strip.

18. The rack assembly as claimed in claim 12, wherein the supporter and the handle are formed as one unit, and attached to the second sidewall.

19. The rack assembly as claimed in claim 12, wherein the supporter is detachable from the handle or the second sidewall.

* * * * *